US010633859B2

(12) United States Patent
Grimsson

(10) Patent No.: US 10,633,859 B2
(45) Date of Patent: Apr. 28, 2020

(54) BUILDING ELEMENT OF MINERAL WOOL AND FIBER-REINFORCED PLASTIC

(71) Applicant: Regin Eysturoy Grimsson, Mosfellsbaer (IS)

(72) Inventor: Regin Eysturoy Grimsson, Mosfellsbaer (IS)

( * ) Notice: Subject to any disclaimer, the term of this patent is extended or adjusted under 35 U.S.C. 154(b) by 0 days.

(21) Appl. No.: 15/577,330

(22) PCT Filed: May 30, 2016

(86) PCT No.: PCT/IS2016/050010

§ 371 (c)(1),
(2) Date: Nov. 27, 2017

(87) PCT Pub. No.: WO2016/189555

PCT Pub. Date: Dec. 1, 2016

(65) Prior Publication Data

US 2018/0148930 A1 May 31, 2018

(30) Foreign Application Priority Data

May 28, 2015 (IS) ..... 9066

(51) Int. Cl.
*E04C 2/22* (2006.01)
*E04C 2/292* (2006.01)
*E04C 2/296* (2006.01)

(52) U.S. Cl.
CPC ..... *E04C 2/22* (2013.01); *E04C 2/292* (2013.01); *E04C 2/296* (2013.01)

(58) Field of Classification Search
USPC ..... 52/309.7, 309.8, 309.9, 309.11, 309.15, 52/309.16
See application file for complete search history.

(56) References Cited

U.S. PATENT DOCUMENTS 3,113,401 A * 12/1963 Rose ..... E04C 2/296 52/417
3,940,893 A * 3/1976 Rausch ..... E04B 1/6812 52/91.3
4,104,840 A * 8/1978 Heintz ..... E04C 2/292 52/309.9
4,346,541 A * 8/1982 Schmitt ..... B32B 3/28 52/309.11

(Continued)

FOREIGN PATENT DOCUMENTS

CN 203361377 * 12/2013

*Primary Examiner* — Paola Agudelo
*Assistant Examiner* — Adam G Barlow
(74) *Attorney, Agent, or Firm* — Patent Grove LLC; Tomas Friend

(57) ABSTRACT

A new type of building element comprising a core of mineral wool which is enclosed in a covering of fiber-reinforced plastic which is closed on the edges, the mineral wool in the form of layered blocks that are arranged in such a way that the layers are essentially perpendicular to the main side panels of the covering. One or more load-bearing structures which comprise fiber-reinforced plastic can connect the opposite main panels of the covering. The load-bearing structures can also comprise various kinds of core materials. The building elements can have a wear coating and various kinds of surfaces, and be used for the construction of buildings and other structures.

13 Claims, 5 Drawing Sheets

(56) References Cited

U.S. PATENT DOCUMENTS 4,662,777 A * 5/1987 Newton ..... E02D 29/124 404/25
4,726,707 A * 2/1988 Newton ..... E02D 29/14 264/258
4,730,428 A * 3/1988 Head ..... E04B 5/026 52/309.11
5,589,243 A * 12/1996 Day ..... B29C 44/5654 428/316.6
5,834,082 A * 11/1998 Day ..... B29C 44/06 428/56
5,943,775 A * 8/1999 Lanahan ..... B26D 1/553 264/142
6,096,416 A * 8/2000 Altenberg ..... B32B 3/06 156/78
6,276,104 B1 * 8/2001 Long, Sr. ..... B29C 44/569 428/318.4
6,942,915 B1 * 9/2005 Kondo ..... B29C 66/1142 428/131
8,733,046 B2 * 5/2014 Naidoo ..... E04B 1/14 52/309.16
9,457,537 B1 * 10/2016 Hundley ..... E04C 2/292
2003/0154682 A1 * 8/2003 Liviero ..... E04C 2/292 52/578
2003/0233796 A1 * 12/2003 Walz ..... E04C 2/292 52/200
2004/0065033 A1 * 4/2004 Bleibler ..... E04C 2/296 52/309.7
2006/0228522 A1 * 10/2006 Dupouy ..... B32B 15/04 428/138
2007/0125042 A1 * 6/2007 Hughes ..... B32B 5/18 52/782.1
2008/0110111 A1 * 5/2008 Bleibler ..... E04C 2/296 52/223.7
2008/0245007 A1 * 10/2008 McDonald ..... E04C 2/246 52/309.5
2009/0311932 A1 * 12/2009 Hughes ..... B32B 5/20 442/224
2011/0250384 A1 * 10/2011 Sumi ..... B60R 5/044 428/118
2012/0231231 A1 * 9/2012 Curtin ..... E04C 2/36 428/192
2013/0227902 A1 * 9/2013 Van Sloun ..... E04C 2/296 52/309.4

* cited by examiner 1
2
2
5
5
2k
2k
3
3
3

BUILDING ELEMENT OF MINERAL WOOL AND FIBER-REINFORCED PLASTIC

FIELD

The invention is in the field of construction, more specifically construction of houses in particular, and regards a new type of building element made of previously known and recognized construction materials that are arranged in a new way. This is a new method of building roofs, floors and external walls using building elements made of fiber-reinforced plastic and mineral wool blocks with built-in load-bearing structures made of fiber-reinforced plastic and closed edges.

INTRODUCTION

Various types of building elements are known. Concrete wall elements are common. There are also sandwich panels with steel in the outer and inner layer without connections between the layers. They are open on the edges and thus need a traditional foundation. Sandwich panels with a steel coat and mineral wool as a core are also open on the edges and therefore also need a traditional foundation. Traditional roofs consist of corrugated metal, tar paper, timber cladding, load-bearing beams, ducts, wind paper, insulation, vapor barrier, framework for electrical wiring and inner cladding.

Various problems accompany known building elements. Concrete wall elements are heavy, cumbersome to transport, and are often accompanied by cracks and leakage problems at the joints. Sandwich panels made of polyurethane and steel are not allowed in the construction of residential buildings. Steel-mineral wool-steel sandwich panels are open sandwich panels that require a traditional foundation and do not have much load-bearing capacity. Wind damage sometimes occurs on wall and roof coverings. Roofs tend to leak.

SUMMARY

The aim of the present invention is to provide a new building element that is light and free of common problems that often accompany known building elements. This aim is achieved with a building element which has a core of appropriately oriented layered mineral wool which is enclosed in a covering of fiber-reinforced plastic which is closed on the edges. The building element can have built-in internal load-bearing structures made of fiber-reinforced plastic which structurally connect (connections by mechanical and chemical fusion) the oppositely arranged main side panels of the covering. The load-bearing structures do not form cold bridges in these building elements and this is a beneficial feature in this innovation in making building elements (a cold bridge is an area, for example in a wall or other building portion, where material that conducts heat well passes through a material that conducts heat poorly, an insulation layer). The inner plastic layer (i.e. "inside" main side panel) of the element is simultaneously a powerful vapor barrier. These building elements are compact and lightweight, and virtually maintenance free. They solve problems with leaks, cracks and mold. The fiber-reinforced plastic is a strong and good building material that performs well under challenging weather conditions. Roof and wall elements made from these building elements are preferably joined by both mechanical and chemical fusion to each other and to external walls of houses made of such elements (material of the same kind). The building element of the present patent application is strong and withstands standing in water (cf. fiberglass boats); therefore the outer walls of the house can go down into the soil and below the frost line or down to bedrock and form the base/foundation of the house. The structure of the elements is such that there is no risk of wind damage since the connection between the exterior and interior layers is structural. This building element makes it possible to produce housing at a lower cost than is known in the construction industry today and thus meets the need of society for affordable housing. On the inside, the house is preferably covered with plasterboard (sheetrock) or the wall is plastered, but on the outside, there is preferably the fiber-reinforced plastic panel of the building element which can preferably be configured with a fire-resistant surface (e.g. Gelcoat material). The outer panel can have the finish that is preferred, for example corrugations, tiles, timber cladding, stacked-stone or turf wall, but the house can also be plastered on the outside.

DESCRIPTION OF VARIOUS EMBODIMENTS

Figure 1:
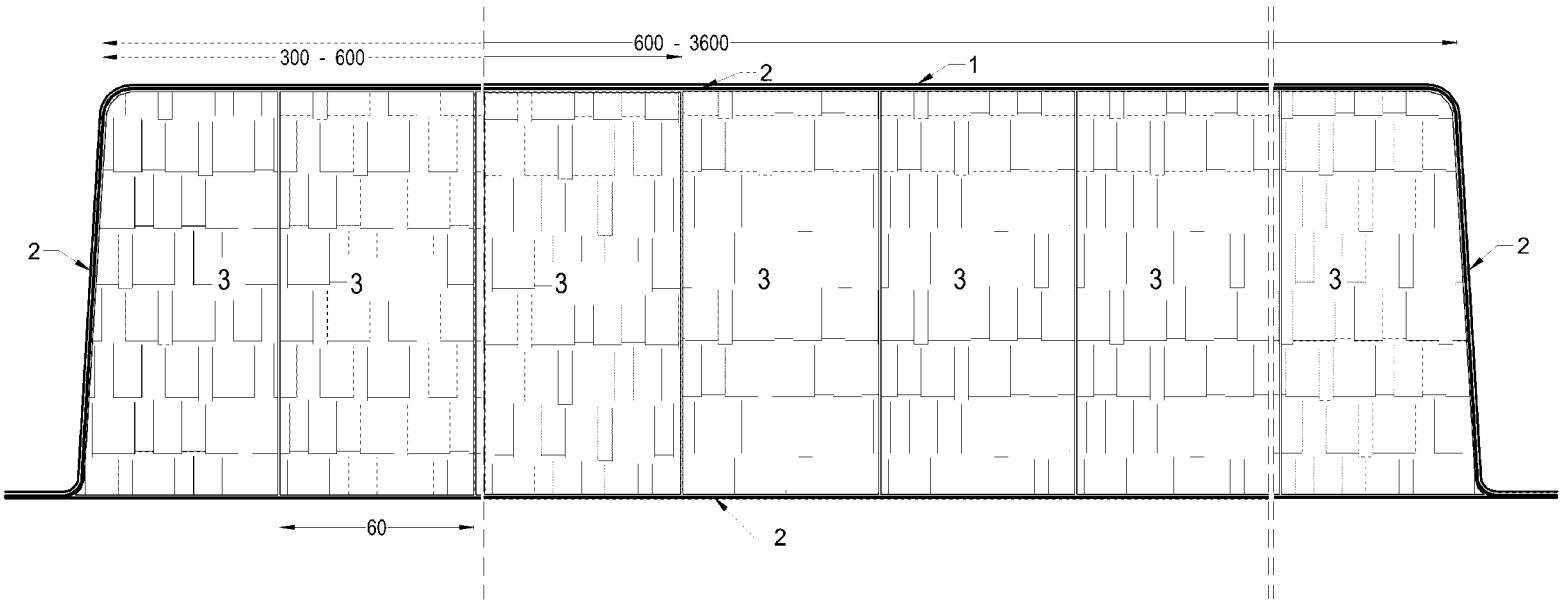
FIG. 1 shows a cross-section of a building element of the invention.
Figure 2:
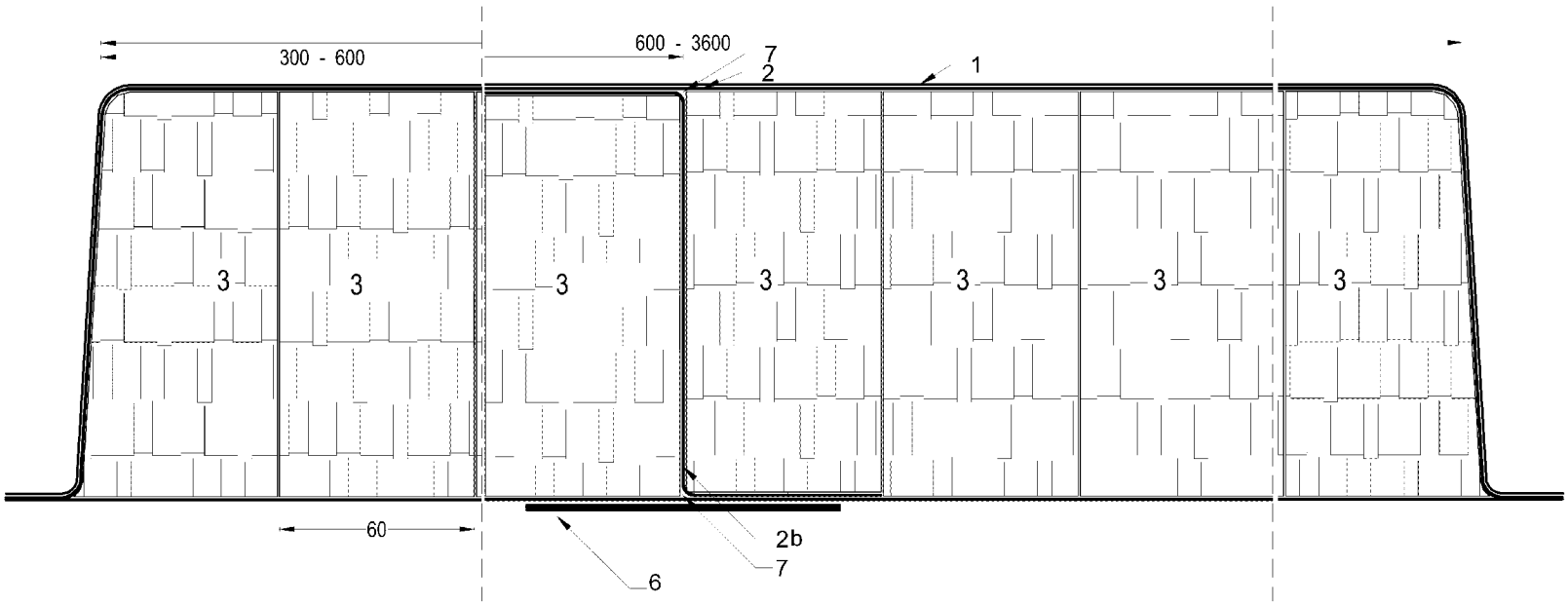
FIG. 2 shows a cross-section of a building element of the invention, with internal load-bearing structures.
Figure 3:
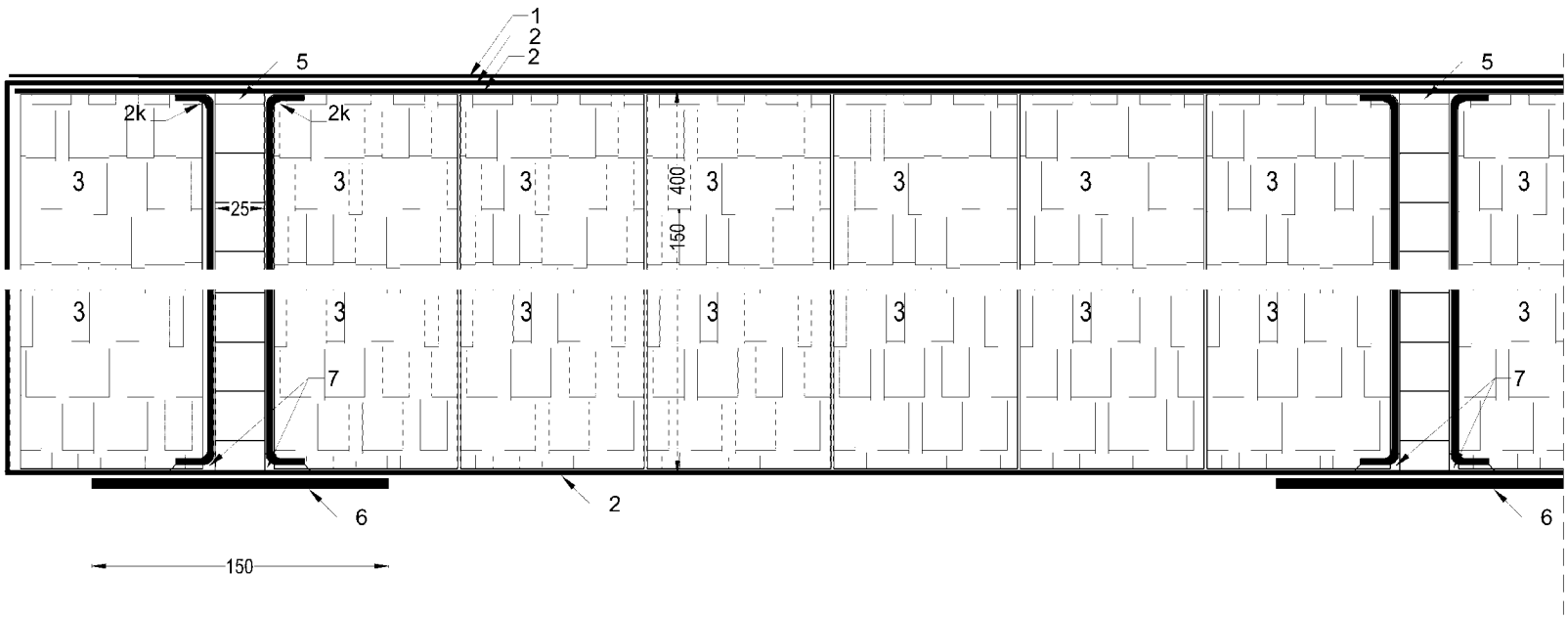
FIG. 3 shows a cross-section of a building element of the invention, with internal load-bearing structures that comprise a core enclosed in a fiber-reinforced plastic covering.
Figure 4:
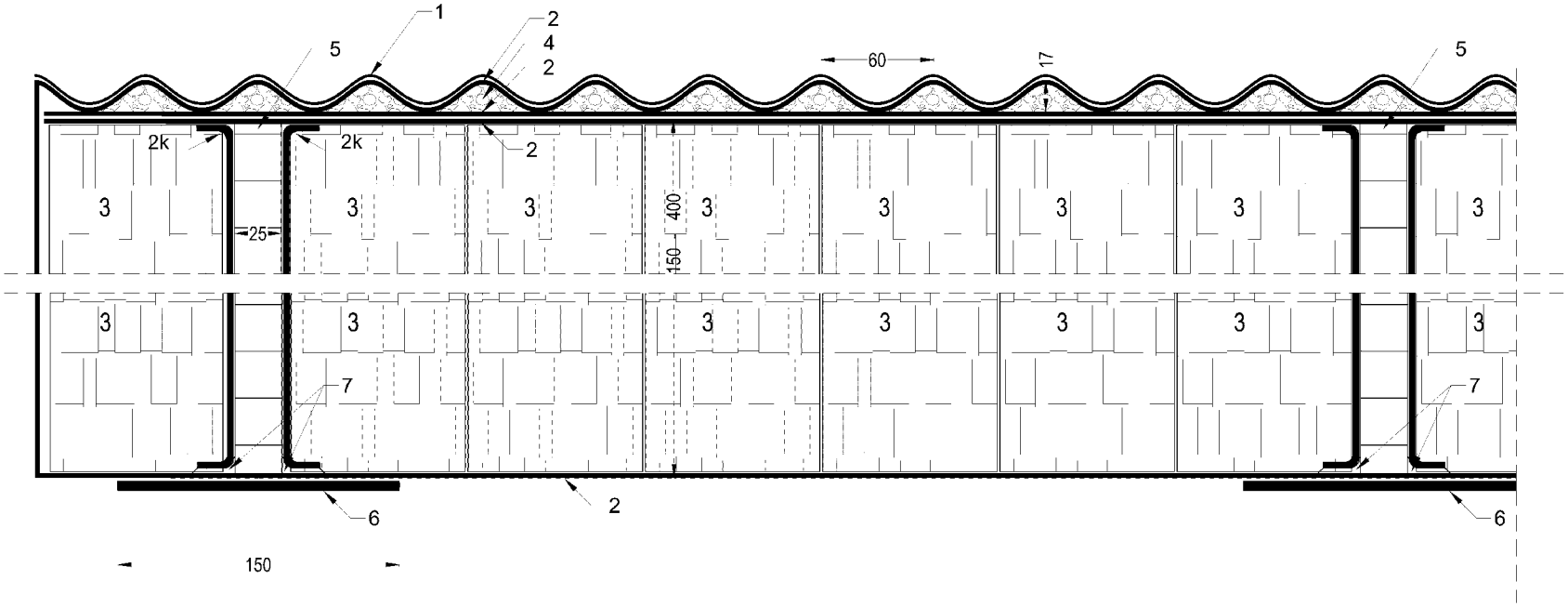
FIG. 4 shows a cross-section of a building element of the invention, with internal load-bearing structures and an added external corrugated surface panel.
Figure 5:
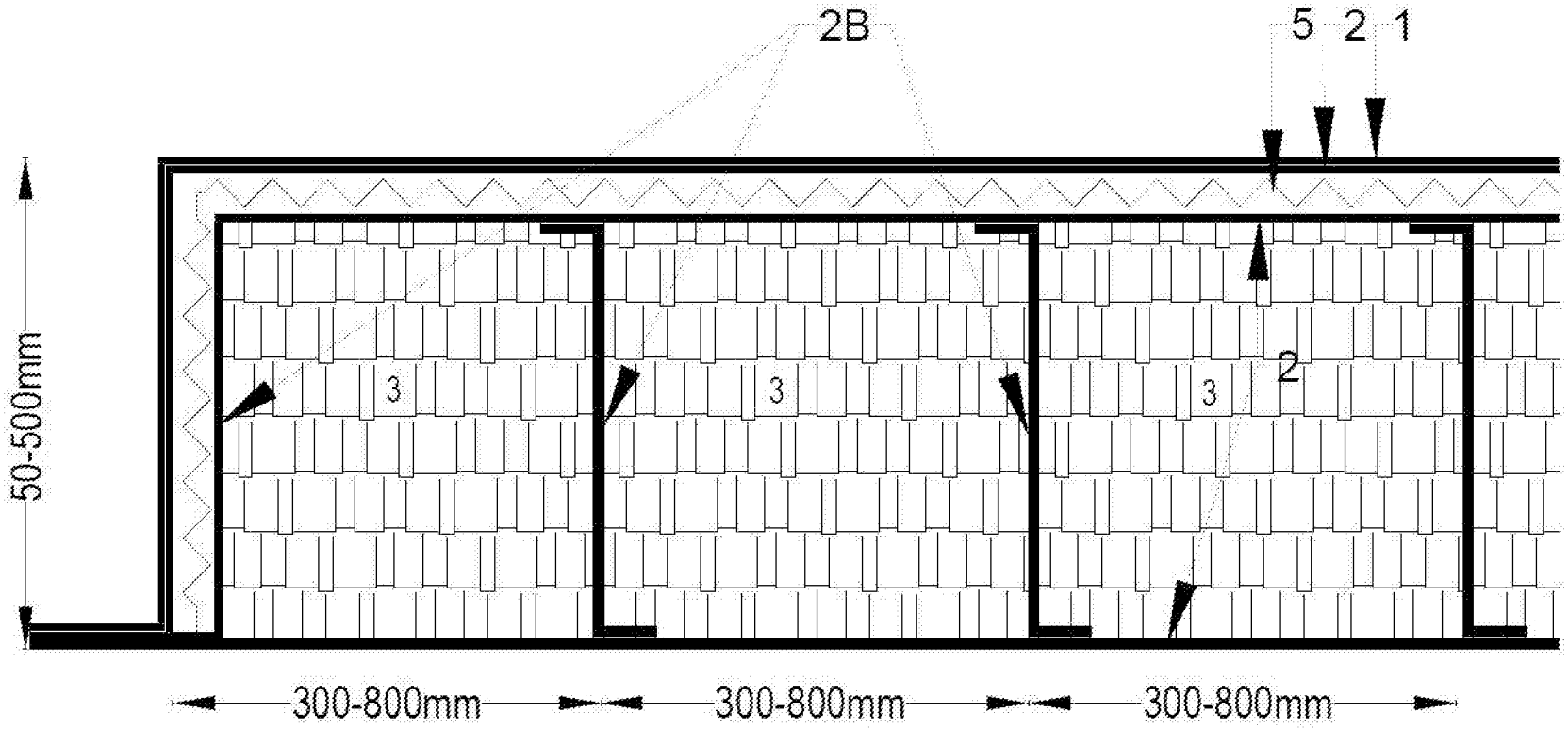
FIG. 5 shows a cross-section of a building element of the invention, with internal load-bearing structures and with a double-layered outer layer of fiber-reinforced plastic with enclosed core material.

The invention is described in more detail below with reference to the accompanying drawings. FIG. 1 shows a cross-section of a building element wherein the main panels of the covering, i.e. external and internal covering layers are joined at the edges with side surfaces on all edges, which are also from the same fiber-reinforced plastic material. Thus, the element forms a closed unit of the two main panels and closing surrounding side surfaces. FIG. 2 shows a cross-section of a building element wherein load-bearing structures made of fiber-reinforced plastic connect the opposite main panels of the covering, FIG. 3 shows a cross-section of a building element with a smooth surface wherein load-bearing structures made from a core material in a covering of fiber-reinforced plastic connect the opposite main panels of the covering, FIG. 4 shows a cross-section of a building element with an added corrugated outermost surface wherein load-bearing structures made from a core material in a covering of fiber-reinforced plastic connect the opposite main side panels of the covering, and FIG. 5 shows a cross-section of a building element with a smooth added outer surface wherein one main side and the connecting structures at the edges of the building element comprise load-bearing structures comprising a core material and load-bearing structures made of fiber-reinforced plastic connect opposite main side panels of the covering.

The basic concept is a building element comprising a core of appropriately oriented layered mineral wool (3) which is enclosed in a covering of fiber-reinforced plastic (2). The mineral wool is arranged in such a way that the layers in the mineral wool (inherent in the production of conventional mineral wool that typically comes in sheets or rolls) are arranged essentially perpendicular to the main panels of the building element. In practice this generally and preferably entails that mineral wool sheets are cut in appropriately wide slices, with a width matching the width in between the man panels of the building elements, and then the slices of mineral wool are turned so that the mineral wool fibers are perpendicular to the main panels. This result in greatly enhanced load bearing of the mineral wool itself and thus much added strength and load of the building element.

The covering comprises oppositely arranged main side panels, that would be respectively an outside surface and an inside surface e.g. of a wall or roof when the element has been installed as part of a wall or roof construction of a house. The main side panels are connected at the edges with side surfaces, and that connection i.e. the side surfaces, serves as a load-bearing structure as well as closing the element. The side surface may further comprise structural features and arrangements to aid in the construction of multiple elements. It is possible to implement the basic concept in various ways. In one of the main embodiments, the building element also comprises one or more internal load-bearing structures which comprise fiber-reinforced plastic (2*b*) generally of the same material as the main panels and side surfaces, and which connect the opposite side panels of the covering of fiber-reinforced plastic. Such are internal load-bearing structures are particularly useful in wide elements with an overall width of 60 cm or wider, such as 80 cm wide, 1 m wide, 1.2 m wide, 1.5 m wide, or wider. It is possible to have many variations of this main embodiment. For example, one or more of the load-bearing structures which connect opposite main side panels of the coating of fiber-reinforced plastic can also comprise a core material (5) in a covering of fiber-reinforced plastic (2*k*). Furthermore, one or both main side panels and one or more of the connecting structures (side surfaces) at the edges of the building element can also comprise a layer of core material (5). The core material can among other things in some embodiments comprise a material selected from polyvinyl chloride foam, polypropylene, polyurethane, polystyrene, polymethyl methacrylate, polyetherimide, styrene-acrylonitrile, balsa wood, plywood, aramid (e.g. Nomex® Honeycomb), or aluminum. The building element may further comprise in some embodiments a unidirectional reinforcement mat (6) above or below the load-bearing structures, and polyester filler (7) in the chinks. The feature "unidirectional" refers to that the mat comprises a fibrous material wherein the fibers lie substantially in parallel. The unidirectional mat is incorporated in the element panel and arranged such that direction of fibers is essentially parallel with the load bearing structure (i.e. perpendicular to the plane of the paper when viewing FIGS. 3 and 4). The building element may also comprise various wear coatings (1), and a smooth, textured or corrugated outer surface. The corrugations as illustrated in FIG. 4 are formed as an integral part of the building element and preferably formed as a separate additional material layer from fiber-reinforced plastic, and can preferably be filled with a mixture of polyester, sand and stones (fine gravel) (4) and are closed at the top and bottom. The layered mineral wool used in the main core (in between the main panels) is preferably in the range from 80 to 200 kg/m$^3$, and typically 120 kg/m$^3$. The layered mineral wool is arranged in such a way that the layers in it are standing (vertical) rather than lying (horizontal) with respect to the main side panels (i.e., essentially perpendicular to the main panels). The covering of fiber-reinforced plastic may comprise various kinds of fibers, including but not limited to glass fibers, carbon fibers, basalt fibers or any mixture thereof. The covering of fiber-reinforced plastic may also comprise various kinds of plastic, including but not limited to various kinds of polyester, vinyl ester, epoxy polymers or mixtures thereof.

It is possible to produce the building elements in various ways. In one method, the elements are cast in appropriate molds. Layered mineral wool blocks are cut to size, depending on the desired thickness of the element. Layered mineral wool which is about 120 kg/m$^3$ (such as is available from Steinull hf., Iceland) is typically used in present embodiments, but it is possible to use in other embodiments layered mineral wool which is in the range from 80 to 200 kg/m$^3$. In one specific embodiment, the layered mineral wool blocks are preferably primed with polyester resin, for example orthophthalic polyester resin from Reichhold or Scott Bader, which goes into the layers and is allowed to harden for at least 1 hour and a maximum of 24 hours before commencing the making of the elements themselves. To begin with, a wear coating, for example an isophthalic polyester "Gelcoat" and/or a fire-resistant "Gelcoat" from Scott Bader, is preferably sprayed into the mold. Then one layer of plastic, 1-3 mm thick, is added, either sprayed or a glass fiber mat made of fiberglass is laid, and allowed to harden for 1-48 hours. Then 1-3 mm of glass fiber is added on top. The layered mineral wool blocks are rotated 90 degrees so that the layers are standing (vertical) rather than lying (horizontal) with respect to the main side panels (i.e., essentially perpendicular to the main side panels) and the blocks are arranged in that way onto the liquid polyester/fiberglass and are then permanently connected to the outer layer. Partitions made from 1-5 mm thick fiberglass or prefabricated sandwich plate with fiberglass covering, depending on the strength desired, are arranged at certain intervals. The distance between connections (load bearing structures) may be preferably in the range from 0.1-1 m, depending on the desired strength of the element. All the chinks between the layered mineral wool blocks are filled with polyester filler (a mix of polyester resin and fumed silica, for example from Reichhold or Scott Bader). To increase the strength of the load bearing structures and hence the element, unidirectional reinforcement mats of different thicknesses (for example from SAERTEX) are added on top of or under the load bearing structures to increase the compressive and tensile strength of the load bearing structures in the element. Sheets of core material, for example 6-10 mm thick, can also be added to the mold after the first 1-3 mm layer of fiberglass and then the second 1-3 mm layer of fiberglass can be added on top of the core material before the mineral wool is added. Sheets of core material can also be added on top of or instead of the unidirectional reinforcement mats. Finally, 1-5 mm of fiberglass is laid over the layered mineral blocks and connections/load bearing structures and the element thereby closed. The layered mineral wool, polyester and glass fibers are connected together with fiberglass in a reliable way so that it does not rely solely on the shear strength or the compression strength of the core, which is the layered mineral wool. The main panels of the element, the layered mineral wool and fiberglass load bearing structures are part of the load bearing/strength of the element, which is closed with fiberglass and thus waterproof. In the elements there is varying need for strengthening depending on whether walls, ceilings or floors are involved. Where there is a need for more strength in the connections between the inner and outer panels, a sandwich with a core of varying thickness is added and varying thickness of the inner and outer layers, for example in roof or floor elements, or the distance between the load bearing structures (ribs) is reduced. The surface of a roof is either smooth or corrugated. The corrugations are filled with polyester and stones (fine gravel).

In one embodiment of the invention illustrated in FIG. 5, the building elements comprise a double-layered outer layer, forming an extra insulating and supporting layer. This has multiple advantages: (i) extra strength is added to the element by the additional layer and core material enclosed in between the extra surface layer and the adjacent fiber-reinforced main side panel, (ii) extra insulation is provided, and (iii) the outermost layer, since it is not directly connected to internal load bearing structures, maintains a flat surface, without risk of bulging from pressure at the sites of connecting internal load bearing structures. In between the additional outermost layer and adjacent main panel is preferably a space of e.g. 5 to 20 mm width and more preferably a width in the range of 8-15 mm, such in the range 8-10 mm. This space is then preferably filled with a layer of core material. The core material (5) is in this embodiment preferably selected form the above mentioned materials such as but not limited to polyvinyl chloride foam, polypropylene, polyurethane, polystyrene, polymethyl methacrylate, polyetherimide, styrene-acrylonitrile, balsa wood, plywood, aramid (e.g. Nomex® Honeycomb), or mixtures or combinations thereof.

The invention claimed is:

1. A building element, said building element comprising:

a core of mineral wool enclosed in a covering of fiber-reinforced plastic comprising two oppositely arranged parallel main side panels and at least one load bearing structure comprising fiber-reinforced plastic wherein:

said covering is closed on the edges, the core comprises layered mineral wool blocks that are arranged in such a way that the layers are essentially perpendicular to the main side panels, said at least one load bearing structure connects the opposite main side panels of the covering, the covering of fiber-reinforced plastic further comprises an outer main side panel that forms an enclosed space between said outer main panel and one of the parallel main side panels, and said outer main side panel is not directly connected to the at least one load bearing structure.

2. The building element according to claim 1, wherein one or both of the two oppositely arranged parallel main side panels comprises a core material in a covering of fiber-reinforced plastic.

3. The building element according to claim 2, wherein the core material of said one or both of the two oppositely arranged parallel main side panels comprises polyvinyl chloride foam, polypropylene, polyurethane, polystyrene, polymethyl methacrylate, polyetherimide, styrene-acrylonitrile, balsa wood, plywood, aramid, aluminum, or any combinations of these.

4. The building element according to claim 1, further comprising a wear coating.

5. The building element according to claim 1, wherein said covering of fiber-reinforced plastic comprises glass fibers, carbon fibers, basalt fibers or any combination of these.

6. The building element according to claim 1, wherein the covering of fiber-reinforced plastic comprises polyester, vinyl ester, an epoxy polymer, or any combination of these.

7. The building element of claim 1, wherein said enclosed space between said outer main panel and one of the parallel main side panels is filled with a core material.

8. The building element of claim 7, wherein said core material with which said enclosed space between said outer main panel and one of the parallel main side panels is filled is selected from: polyvinyl chloride foam, polypropylene, polyurethane, polystyrene, polymethyl methacrylate, polyetherimide, styrene-acrylonitrile, balsa wood, plywood, aramid, aluminum, and any combination of these.

9. A house comprising a building element according to claim 1.

10. The house of claim 9, comprising at least one of an outer wall, a ceiling, and a floor made of building elements according to claim 1.

11. The building element according to claim 1, wherein the at least one load bearing structure that connects the opposite main side panels of the covering comprises a core material in a covering of fiber-reinforced plastic.

12. The building element according to claim 11, wherein the core material of the the at least one load bearing structure comprises polyvinyl chloride foam, polypropylene, polyurethane, polystyrene, polymethyl methacrylate, polyetherimide, styrene-acrylonitrile, balsa wood, plywood, aramid, aluminum, or any combinations of these.

13. The building element according to claim 11, further comprising a unidirectional reinforcement mat on top of or under the at least one load bearing structure.

* * * * *